United States Patent [19]

Miscioscio et al.

[11] Patent Number: 4,487,665

[45] Date of Patent: Dec. 11, 1984

[54] ELECTROPLATING BATH AND PROCESS FOR WHITE PALLADIUM

[75] Inventors: Kathleen B. Miscioscio, Bayside, N.Y.; Paul T. Smith, Pascoag, R.I.

[73] Assignee: OMI International Corporation, Warren, Mich.

[21] Appl. No.: 217,319

[22] Filed: Dec. 17, 1980

[51] Int. Cl.[3] ..... C25D 3/52

[52] U.S. Cl. ..... 204/47; 204/44.6

[58] Field of Search ..... 204/47, 43 N

[56] References Cited

U.S. PATENT DOCUMENTS

| | | | |
|---|---|---|---|
| 3,458,409 | 7/1969 | Hayashi et al. | 204/43 N |
| 3,580,820 | 5/1971 | Yamamura et al. | 204/43 N |
| 3,677,909 | 7/1972 | Yamamura et al. | 204/43 N |
| 3,925,170 | 12/1975 | Skomoroski et al. | 204/43 N |
| 4,066,517 | 1/1978 | Stevens et al. | 204/43 N |
| 4,098,656 | 7/1978 | Deuber | 204/47 |
| 4,297,177 | 10/1981 | Fletcher et al. | 204/43 N |

*Primary Examiner*—G. L. Kaplan

*Attorney, Agent, or Firm*—Richard P. Mueller

[57] ABSTRACT

Particular electroplating baths suitable for obtaining white deposits of palladium metal. The bath comprises (a) palladosamine chloride; (b) an ammonium salt such as ammonium sulfate or ammonium chloride; (c) chloride ions; and (d) a brightener selected from the group of organic brighteners, inorganic brighteners, and mixtures thereof. The process of using such electroplating baths to produce white deposits of palladium metal on substrates is also disclosed and claimed.

4 Claims, 1 Drawing Figure

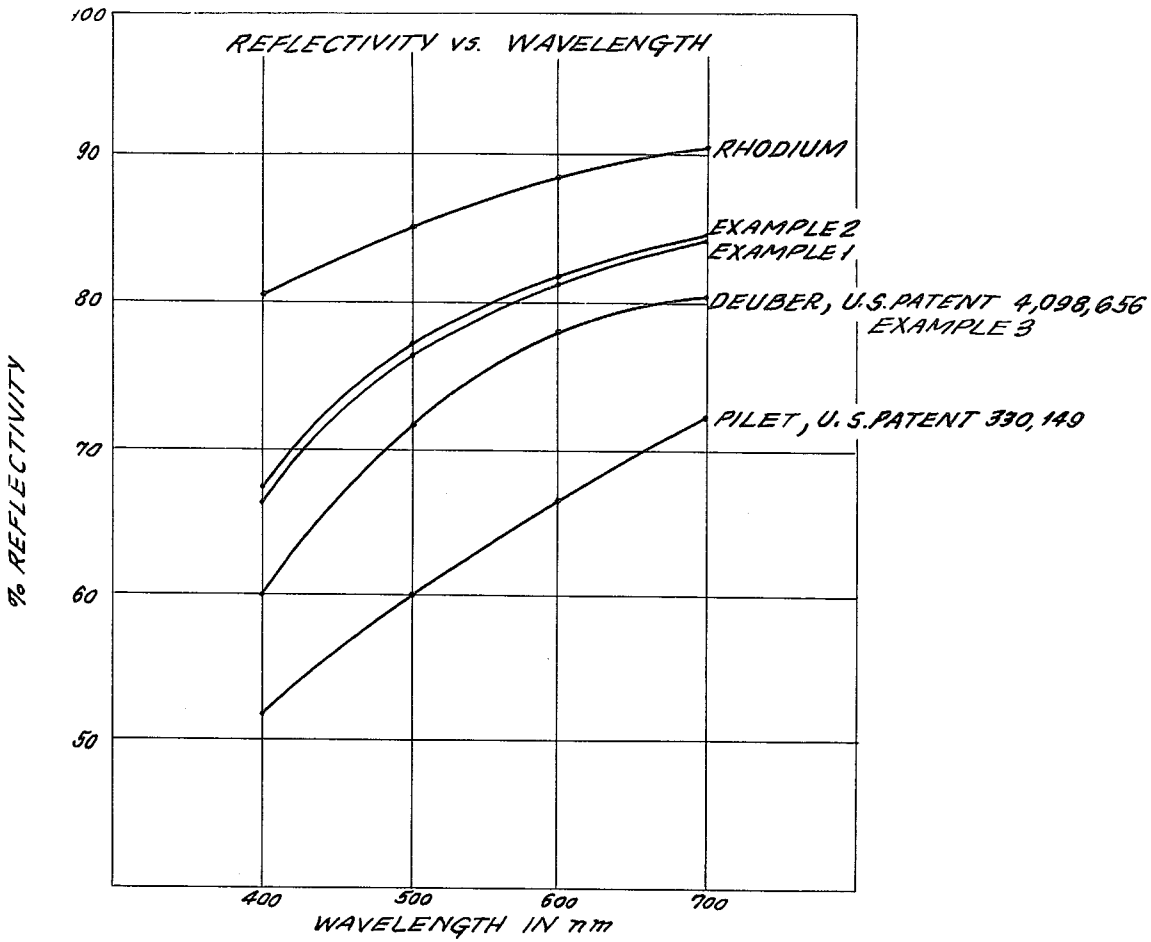
REFLECTIVITY VS. WAVELENGTH
RHODIUM
EXAMPLE 2
EXAMPLE 1
DEUBER, U.S. PATENT 4,098,656
EXAMPLE 3
PILET, U.S. PATENT 330,149
100
90
80
70
60
50
% REFLECTIVITY
400
500
600
700
WAVELENGTH IN nm

ELECTROPLATING BATH AND PROCESS FOR WHITE PALLADIUM

BACKGROUND OF THE INVENTION

The present invention relates to an electroplating bath for the deposition of white palladium metal on various surfaces. More particularly, the invention is concerned with baths for producing thin deposits of white palladium metal.

As is known in the art, the use of conventional palladium baths produces deposits which are grey in color. There are rhodium baths, on the other hand, known to produce white deposits which are very useful in the decorative art industries. In view of the relatively high cost of rhodium as compared to palladium, it would be desirable to be able to obtain a white finish from palladium baths as a substitute for the rhodium finishes now being employed. Previous attempts to produce a white palladium metal deposit were unsuccessful because the deposit was not white enough for the intended purposes, e.g., as a substitute for the conventional white rhodium deposits. It would also be useful for commercial purposes to be able to obtain readily thin, white deposits of palladium metal.

U.S. Pat. No. 330,149 which issued to Pilet et al. 1885 does mention the production of a "white palladium deposit". The electroplating bath of Pilet et al. contained palladium chloride, ammonium phosphate, sodium phosphate or ammonia, and, optionally benzoic acid. The operating pH of the bath is not disclosed, although it is stated that ammonia is "boiled" off and "the liquid which was alkaline, becomes slightly acid." As indicated, the use of benzoic acid is disclosed to be optional, but the patentees disclose that it bleaches the deposit and makes the deposit more striking on iron and steel.

Electroplating baths designed to improve the brightness of palladium or palladium alloy deposits on metal substrates are also known in the art. See, for example, U.S. Pat. No. 4,098,656 which issued to Deuber in 1978. In this patent the improved brightness is achieved by utilizing in the bath both a Class I and a Class II organic brightener and an adjusted pH range of from 4.5 to 12.

In the drawing, the single FIGURE is a graph which illustrates the whiteness of the palladium deposits of the present invention as compared to those of the prior art.

SUMMARY OF THE INVENTION

In accordance with the present invention it has now been discovered that thin, white palladium metal deposits can be readily obtained from very specific electroplating bath formulations containing a bath soluble source of palladium and certain other components. Such components include a bath soluble ammonium conductivity salt, such as ammonium sulfate or ammonium chloride; chloride ions; and a brightener from the groups of organic and inorganic brighteners, preferably the combined use of both an organic and an inorganic brightener.

Although ammonium hydroxide may also be added to the system, its use is not an essential feature of the present invention. It will be understood that the ammonium salts utilized in formulating these novel electroplating baths act as the elctrolyte or conductive salts.

DETAILED DESCRIPTION OF THE INVENTION

The source of the palladium metal in the electroplating baths of this invention may be any palladium amine complex, such as the nitrate, nitrite, chloride, sufate and sulfite complexes. Typical of such complexes which may be used are palladium diaminodinitrite and palladosamine chloride, with palladosamine chloride being preferred. The palladium content of the plating bath will be at least sufficient to deposit palladium on the substrate when the bath is electrolyzed but less than that which will cause darkening of the deposit. Typically, the palladium concentration will be about 0.1 to 20 grams/liter, with concentrations of about 1 to 6 grams/-liter being preferred.

The conductivity salt or electrolyte may be any bath soluble ammonium salt, such as dibasic ammonium phosphate, ammonium sulfate, ammonium chloride or the like. Mixtures of such salts may also be utilized. The amount of these ammonium salts in the plating bath will be at least that which will provide sufficient conductivity to the bath to effect the palladium electrodeposition up to the maximum solubility of the salt in the bath. Typically, the ammonia conducting salt will be present in an amount of about 25 to 120 grams/liter, with amounts of about 30 to 70 grams/liter being preferred.

The organic brighteners used in the present invention are the Class I and Class II nickel brighteners. Organic brighteners which can be employed for the present purposes are described in Modern Electroplating, 2 Ed, F. A. Lowenheim (Ed.) pages 272 et seq. (1963) and Metal Finishing Guidebook & Directory, 42 Ed., pages 358 et seq. (1973). Such brighteners are disclosed in column 1, line 2, to column 2, line 8, of U.S. Pat. No. 4,098,656; the disclosure of which is incorporated herein by reference. Specific organic brighteners which have been found to be especially useful for the purposes are enumerated on the following page.

CLASS I NICKEL BRIGHTENERS

Saccharin
Sodium Benzene Sulfonate
Benzene Sulfonamide
Phenol Sulfonic Acid
Methylene bis(naphthalene) Sulfonic Acid

CLASS II NICKEL BRIGHTENERS

2-Butyne-1,4-diol
Benzaldehyde-0-sodium sulfonate
2-Butene-1,4-diol
Allyl sulfonate Some compounds may fall within the description of both Class I and II, but that will not affect their utility in the present baths. As distinct from the requirement of U.S. Pat. No. 4,098,656 that at least one brightener from each class of nickel brighteners must be used in the present invention only one organic brightener from either class has to be employed in order to obtain the desired results.

The inorganic brighteners may be any bath soluble nickel compounds such as nickel sulfate, ammonium nickel sulfate, or the like, and mixtures thereof. Preferably, and this is another feature of the present invention, both organic and inorganic brighteners are utilized in formulating the baths of this invention. The amount of organic brightener will range from about 0.5 to 5 g/l, and preferably about 1 to 3 g/l; the amount of inorganic brightener will range from about 0.1 to 1.0 g/l, and preferably from about 0.2 to 0.5 g/l.

In accordance with another feature of the present invention chloride ions, which may be derived from potassium and sodium chloride, are added to the plating bath to prevent film formation on the anode, When potassium chloride is employed, it may be used in amounts of from about 5 to 30 g/l, and preferably from about 10 to 20 g/l. The amount of chloride ions in the bath may range from about 2.5 to 15 g/l, preferably 5 to 10 g/l. It will be understood that excess chloride ions are not detrimental to the operations of the bath; and that if ammonium chloride is employed as the conducting salt, the amount of chloride ions may be greater than 15 g/l.

The electroplating baths of this invention may contain other ingredients useful in this art, provided that they do not have any deleterious results on the formation of the desired thin deposits of white palladium metal. Thus, for example, the plating bath may contain ammonium hydroxide in amounts ranging from about 0 to 50 ml/l, preferably 5 to 15 ml, without untoward results.

The pH of the plating bath will generally be maintained within the range of about 5 to 10, preferrably about 5 to 8; the more alkaline plating solutions being obtained by the use of ammonium hydroxide.

The temperature of the bath during plating operations will range from about room temperature to 160° F. In order to avoid the emission of excess ammonia, the plating temperature preferably will be below 130° F. In general, operating temperatures of from about 50°–122° F. are used. Current densities from about 0.1 to 50 ASF (i.e., 0.01 to 5.0 A/dm$^2$) are suitable for the present purposes. For rack plating a current density of 2 to 20 is employed.

A further feature of the present invention is to produce thin deposits of palladium so as to further ensure the production of a white deposit. Thus, the deposit thicknesses may vary from about 0.01 to 1.0 micron, and preferably from 0.03 to 0.4 micron.

The "whiteness" characteristic of the present invention is quantified in terms of white light reflectivity measured by spectrophotometric methods such as utilizing a Perkin-Elmer 559 Spectrophotometer and plating the deposits to be studied over 1 inch by 1 inch panels preplated with 0.5 mils of copper and 0.5 mils of nickel, hereinafter referred to as the nickel plated panels, to eliminate surface imperfections. The white light reflectivity of these panels is scanned in the transmittance mode from 400 to 700 nanometers against a magnesium oxide reference plate. The sample deposit scan is then compared to a similar scan of a rhodium deposit.

Preferred electroplating baths according to the invention are as follows:

| Component | Concentration |
|---|---|
| Palladosamine Chloride | 1 to 6 g/l (as Pd) |
| Conducting Salt | 30 to 70 g/l |
| Potassium Chloride | 10 to 20 g/l |
| Organic Brightener | 1 to 3 g/l |
| Inorganic Brightener | 0.2 to 0.5 g/l |
| Ammonium Hydroxide | 0 to 50 ml/l |

The invention will be more fully understood by reference to the following illustrative examples, wherein the temperatures are given in degrees centigrade.

EXAMPLE 1

A palladium electrolyte solution was prepared by dissolving the following ingredients in water:

| Component | Concentration |
|---|---|
| Palladosamine Chloride* | 2 g/l (as Pd) |
| Ammonium Sulfate | 60 g/l |
| Potassium Chloride | 15 g/l |
| Benzaldehyde-o-Sodium Sulfonate | 2 g/l |
| Ammonium Nickel Sulfate | 0.5 g/l |

*$[Pd(NH_3)_2Cl_2]$

The pH of the plating bath was 5.5 to 7 during plating operations at a temperature of 45°–55° C. and a current density of 10–20 ASF to deposit a white palladium electroplate having a thickness of 0.25 to 0.35 microns on a nickel plated panel.

EXAMPLE 2

A plating bath, somewhat similar to that of Example 1, was formulated as follows:

| Component | Concentration |
|---|---|
| Palladosamine Chloride | 2 g/l (as Pd) |
| Ammonium Sulfate | 30 g/l |
| Potassium Chloride | 15 g/l |
| Ammonium Hydroxide | 8 ml/l |
| Benzaldehyde-o-Sodium Sulfonate | 2 g/l |
| Nickel Sulfate | 0.2 g/l |

The pH of the plating bath ranged from 5.5 to 7 during operations at a temperature of 50° C. and a current density of 4–15 ASF to deposit a white palladium electroplate having a thickness of 0.25 to 0.35 microns on a nickel plated panel.

In the following Table the white light reflectivity of the palladium deposits on the nickel plated panels of Examples I and II was compared with a rhodium deposit on a nickel plated panel as well as deposits made in accordance with Example 3 of the Deuber U.S. Pat. No. 4,098,656 and the Pilet U.S. Pat. No. 330,149 (page 1, lines 77–102 and page 2, lines 1–8). The deposits of the Pilet and Deuber patents had a thickness of 0.25 to 0.35 microns. The Perkin-Elmer spectrophotometer and the test procedure described above were employed.

TABLE 1

| | % Reflectivity | | | |
|---|---|---|---|---|
| Deposit | 400 nm | 500 nm | 600 nm | 700 nm |
| Rhodium | 80.5 | 85.0 | 88.5 | 90.5 |
| Deuber | 60.0 | 71.5 | 78.0 | 80.5 |
| Pilet | 51.5 | 60.0 | 66.5 | 72.0 |
| Example 1 | 66.0 | 76.5 | 81.5 | 84.0 |
| Example 2 | 67.0 | 77.0 | 82.0 | 84.5 |

The foregoing data reveal that the electroplating baths of this invention produce a significantly improved palladium metal deposit as to white light reflectivity when compared to both Deuber and Pilet. The visual difference in whiteness is so significant that for commercial applications it can be the difference between acceptance and rejection.

When the foregoing data are plotted, percentage reflectivity versus wavelength, as in the accompanying drawing, the resulting graph further reveals the significance between the results achieved by the practice of the present invention and the prior art.

Scanning Electron Microscope (SEM) Micrographs were made of the deposit produced in Example 1 and those produced by the procedures of the Pilet et al and Deuber patents. These Micrographs show that the Pilet et al deposits have extensive dendritic deposits and surface roughness. The Deuber deposits, while showing somewhat reduced dendritic growth than Pilet et al, still have considerable surface roughness. In contrast, the deposit from Example 1 is smoother with much less dendritic deposits than Deuber. This further illustrates the unique properties of the deposits produced by the present invention and indicates the correlation between the smoothness of the deposit and its white light reflectivity.

It will be further understood that the examples set forth above are illustrative only, and that they are subject to further changes and modifications without departing from the broader aspects of this invention.

What is claimed is:

1. A stable, aqueous electroplating bath suitable for obtaining thin white deposits of palladium metal which consists essentially of a bath soluble source of pure palladium metal free of alloying elements, which source is present in an amount sufficient to provide from about 0.1 to 20 g/l palladium in the bath, from about 25 to 120 g/l of a bath soluble ammonium conductivity salt, from about 0.5 to 5 g/l of an organic brightener selected from Class I and Class II nickel brighteners, from about 0.1 and 1 g/l of an inorganic brightener and 2.5 to 15 g/l of chloride ions furnished by potassium chloride.

2. A stable, aqueous electroplating bath suitable for obtaining thin, white deposits of palladium metal which consists essentially of a bath soluble source of pure palladium metal free of alloying elements present in an amount sufficient to provide from 1 to 6 g/l palladium in the bath, from 30–70 g/l of a bath soluble ammonium conductivity salt, from about 0.5 to 5 g/l of an organic brightener selected from Class I and Class II nickel brighteners, and from about 0.2 to 0.5 of nickel sulfate.

3. A stable, aqueous electroplating bath suitable for obtaining thin, white deposits of palladium metal which consists essentially of a bath soluble source of pure palladium metal free of alloying elements present in an amount sufficient to provide from 1 to 6 g/l palladium in the bath, from 30–70 g/l of a bath soluble ammonium conductivity salt, from about 0.5 to 5 g/l of an organic brightner selected from Class I and Class II nickel brightners, and from about 0.2 to 0.5 g/l of ammonium nickel sulfate.

4. A method of depositing white deposits of palladium metal on a substrate which comprises passing an electric current through the electroplating baths of claims 1, 2 or 3 between a cathode and an anode for a period of time sufficient to produce a palladium electrodeposit having a thickness of from about 0.01 to 1.0 microns.

* * * * *